US005449012A

United States Patent [19]

Friedman

[11] Patent Number: 5,449,012

[45] Date of Patent: Sep. 12, 1995

[54] UMBRELLA ASSEMBLY

[75] Inventor: Larry D. Friedman, Golden Valley, Minn.

[73] Assignee: Rain or Shine, Inc., Golden Valley, Minn.

[21] Appl. No.: 286,390

[22] Filed: Aug. 5, 1994

Related U.S. Application Data

[63] Continuation of Ser. No. 85,598, Jul. 1, 1993, abandoned.

[51] Int. Cl.[6] ..... A45B 3/00; A45B 23/00

[52] U.S. Cl. ..... 135/16; 135/20.3; 135/25.41

[58] Field of Search ..... 135/16, 20.3, 22, 24, 135/25.41, 910, 911

[56] References Cited

U.S. PATENT DOCUMENTS

| | | | |
|---|---|---|---|
| D. 23,790 | 11/1894 | Conkling . | |
| 1,683,270 | 9/1928 | Taylor et al. | 135/16 |
| 2,224,882 | 12/1940 | Peck | 135/2 |
| 2,729,220 | 1/1956 | Smyrnow | 135/16 |
| 4,456,023 | 6/1984 | Fugihashi | 135/25 R |
| 4,543,971 | 10/1985 | Sirota | 135/20.3 X |
| 4,562,849 | 1/1985 | Sirota | 135/20.3 X |
| 4,583,080 | 4/1986 | DiVito et al. | 135/910 X |
| 4,622,987 | 11/1986 | Redl et al. | 135/20 M |
| 4,763,679 | 8/1988 | Lerch | 135/20.3 |
| 4,788,995 | 12/1988 | Rushing | 135/16 |
| 4,867,187 | 9/1989 | Divine | 135/16 |
| 4,915,670 | 4/1990 | Nesbit | 455/344 |
| 4,962,779 | 10/1990 | Meng | 135/16 |
| 5,029,239 | 7/1991 | Nesbit | 455/344 |
| 5,141,010 | 8/1992 | Muller et al. | 135/20.3 |

FOREIGN PATENT DOCUMENTS

| | | | |
|---|---|---|---|
| 2477388 | 9/1981 | France | 135/910 |
| 3737347A1 | 5/1989 | Germany | 135/910 |
| 2222942 | 3/1990 | United Kingdom | 135/910 |
| 90/12520 | 11/1990 | WIPO | 135/66 |

OTHER PUBLICATIONS

*Batman Returns* (motion picture), released 1992.

*Hong Kong Magazine,* "Products That Make You Laugh" (Singing in the Rain), Tradepower, Aug. 1981, p. 238.

*Primary Examiner*—Carl D. Friedman

*Assistant Examiner*—Kevin D. Wilkens

*Attorney, Agent, or Firm*—Kinney & Lange

[57] ABSTRACT

A hand-held umbrella with a mechanism for rotating the stem and dome of the umbrella relative to the handle without manual rotation of the handle or umbrella. The rotation is created by a battery operated motor forming a portion of the handle and adapted to receive the end of the stem opposite of the dome. The exterior surface of the dome may have a picture message imprinted thereon which has the appearance of animated movement when the dome is rotated. A speaker and mechanism for producing audible sound are also incorporated into the handle. In one embodiment, the music is contained on a sound synthesizer chip.

4 Claims, 7 Drawing Sheets

UMBRELLA ASSEMBLY

This is a Continuation of application Ser. No. 08/085,598, filed Jul. 1, 1993, now abandoned.

BACKGROUND OF THE INVENTION

The present invention relates to the field of umbrellas, particularly hand-held umbrellas.

Hand-held umbrellas are used by individuals of all ages and occupations for a variety of reasons and in a variety of manners. For example, they may be used as protection from the sun or the rain, or for promotional opportunities when the dome of the umbrella is imprinted with a promotional message. An umbrella dome is sometimes spun to provide a visual effect, for example as in dance recitals which have participants manually twirling umbrellas of various sizes, colors and designs. The theme or atmosphere to be created by the rotated dome design may be enhanced by the presence of an appropriate musical tune, such as that provided by a band or loud speaker system.

Rotating umbrellas have been previously disclosed. Peck U.S. Pat. No. 2,224,882 discloses a "giant" umbrella whose housing is imbedded in the ground. The umbrella may be rotated by a motor or other powered member. Smyrnow U.S. Pat. No. 2,729,220 discloses a revolving fan parasol with apparatus for creating a current of air directed over the body of the user. The rotation of the parasol is accomplished by actuation of a mechanical crank at the handle portion of the parasol. Redl et al. U.S. Pat. No. 4,622,987 discloses a rotatable shade umbrella tiltable about a horizontal axis and which can be rotated about a vertical axis. Each of the previously disclosed rotating umbrellas requires either manual actuation of the rotation mechanism, or if motorized, attachment to the ground or similarly solid surface.

Umbrellas with radios incorporated into the umbrella handles also have been previously disclosed. Nesbit U.S. Pat. No. 4,915,670, Nesbit U.S. Pat. No. 5,029,239 and Devine U.S. Pat. No. 4,867,187 disclose umbrellas with radios incorporated into the umbrella handles. Devine discloses an umbrella handle with a removable radio handle which includes earphones for listening to the radio. Nesbit U.S. Pat. No. 5,029,239 includes a radio attached to the shaft of the umbrella and speaker assemblies attached to the inside of the dome of the umbrella.

SUMMARY OF THE INVENTION

The present invention includes a device for rotating the stem and dome of a hand-held umbrella relative to the handle without requiting regular and frequent manual actuation of the handle. The invention also incorporates an audible sound source into the umbrella handle to enhance the theme or atmosphere created by the rotating umbrella dome. The present invention can be used for creating visual displays and animations for promotional and novelty purposes.

The device of the present invention includes a standard umbrella dome and a stem for supporting the dome, one end of the stem being attached to the dome in a conventional manner, the opposite end of the stem removably attached to a handle. The handle includes a battery operated motor forming a portion of the handle and adapted to receive the end of the stem opposite the dome. The handle also includes a speaker and a means for producing audible sounds (such as music) incorporated into the handle. When a switch on the handle is actuated, the motor causes the stem and dome to rotate, and the sound source is turned on.

In one preferred embodiment, the sound producing means is a sound synthesizer chip containing a permanently fixed audible sound. Alternatively, the sound producing means can be a radio, compact disc player, cassette deck or other audio source, either integrally included in the handle or connected by means of an audio jack incorporated into the handle.

The present invention thus has advantages over the prior art. Prior rotating umbrellas either required regular and frequent manual actuation if they were hand-held, or if the umbrella rotation was created by a force other than manual actuation, the umbrella was not capable of being hand-held. The present invention incorporates a motorized rotation mechanism into a hand-held umbrella, a feature lacking in the prior art. The present invention requires only a single discrete actuation of a switch incorporated into the handle to cause continuous rotation of the stem and dome. Additionally, the prior art does not combine dome rotation with an accompanying sound to embellish the dome rotation's aesthetic effects. To maximize the effect of the presentation created by the combined sound and dome rotation, it is often desired to use specific musical tunes. A radio is unable to accomplish this task on demand. However, with the present invention, the sound producing means can play music stored on a fixed medium, such as a musical synthesizer chip, compact disc, or audio cassette tape. This allows the user to selectively choose a sound to be played by the sound producing means which will best enhance the dome design's theme.

BRIEF DESCRIPTION OF THE DRAWINGS

The invention will be further described with reference to the accompanying drawings where like numbers refer to like parts in several views and wherein.

While the above-identified features set forth preferred embodiments, other embodiments of the present invention are also contemplated, as noted in the discussion. This disclosure presents illustrated embodiments of the present invention by way of representation and not limitation. It should be understood that numerous other modifications and embodiments can be devised by those skilled in the art which fall within the scope and spirit of the principles of the invention.

DETAILED DESCRIPTION OF THE PREFERRED EMBODIMENTS

An embodiment of the present invention includes a device for causing rotation of the stem and dome of an umbrella relative to the handle without requiring regular and frequent manual actuation of the handle, while at the same time selectively providing sounds appropriate to enhance the theme or atmosphere created by the rotating umbrella dome. The invention can be used for creating visual displays and animations for a variety of purposes. In one preferred embodiment the audio source is a sound synthesizer chip incorporated into the handle, and in other embodiments the audio source is a radio, a tape cassette player, or a compact disc player.

Figure 1:
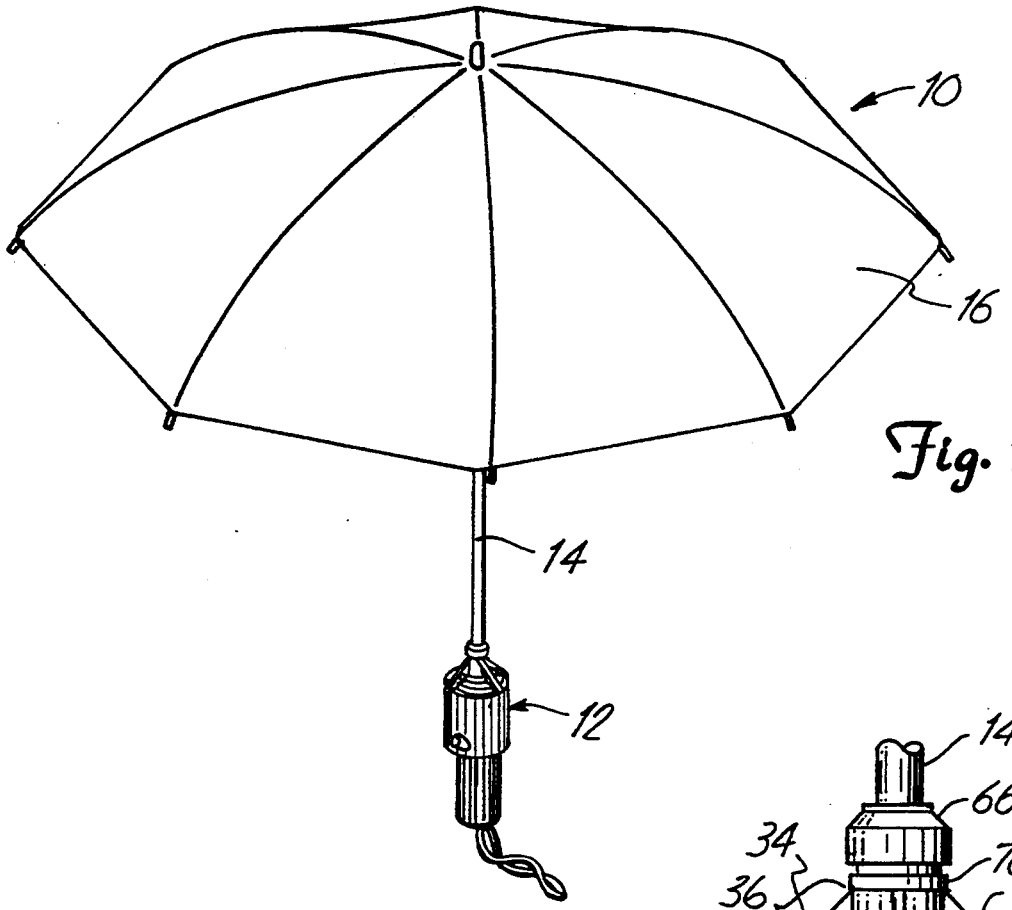
FIG. 1 is a perspective view of the present invention including a basic umbrella dome and stem.
Figure 1A:
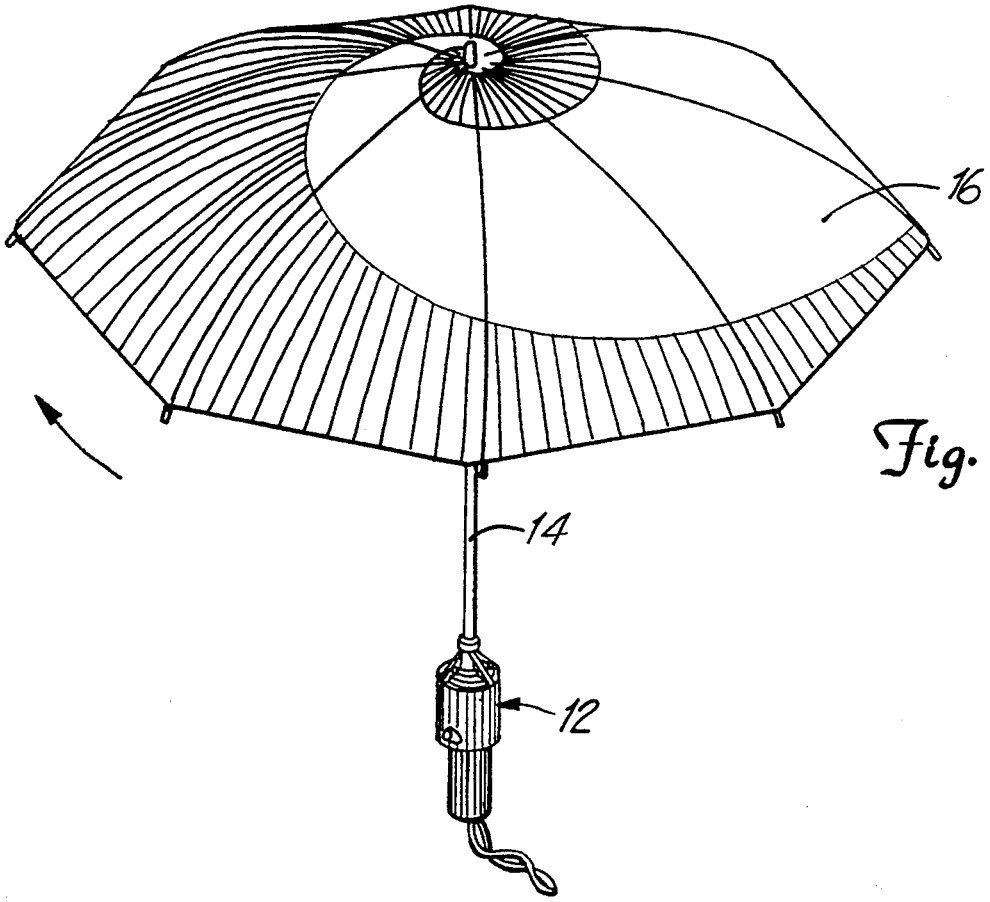
FIG. 1A is a perspective view of the present invention, showing an illustrative dome design.
Figure 1B:
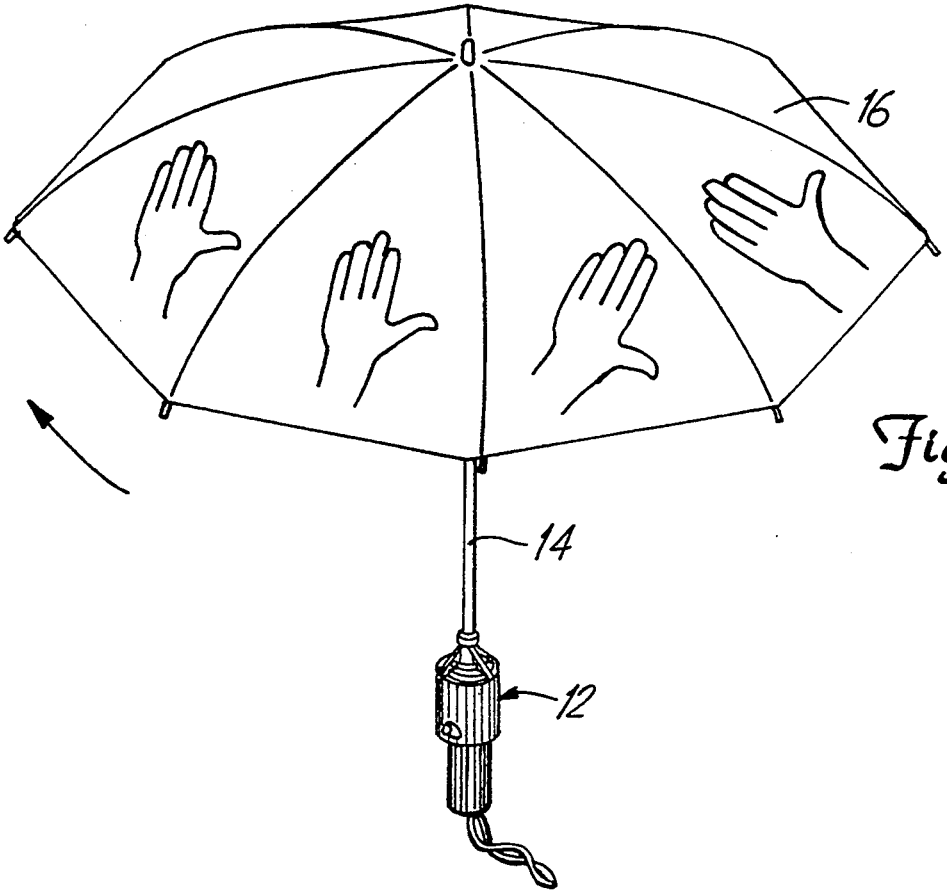
FIG. 1B is a perspective view of the present invention, showing an alternative illustrative dome design.

As generally seen in FIG. 1, an umbrella 10 includes preferably a handle 12 attached to a first end of a stem 14, and a dome 16 supported adjacent a second end of the stem 14. The stem 14 and the dome 16 are basic umbrella components. The dome 16 may be imprinted with designs such as multi-colored spirals, cartoon character animation, or a kaleidoscope type visual presentation, the rotation of the stem 14 and the dome 16 creating the appearance, or illusion, of visual movement. FIGS. 1A and 1B show illustrative types of dome designs. FIG. 1A illustrates a spiral design, and FIG. 1B illustrates an animated waving hand.

Figure 2:
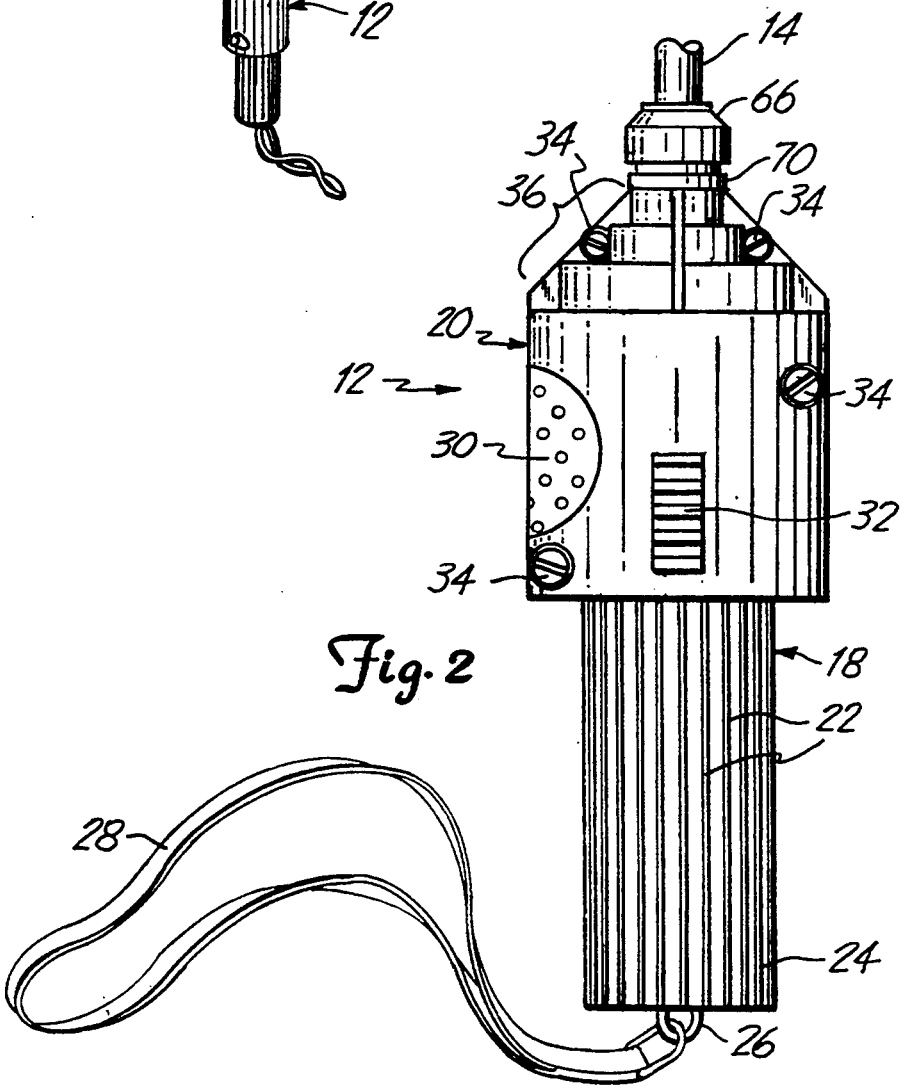
FIG. 2 is a view in side elevation of an umbrella handle of the present invention.
Figure 3:
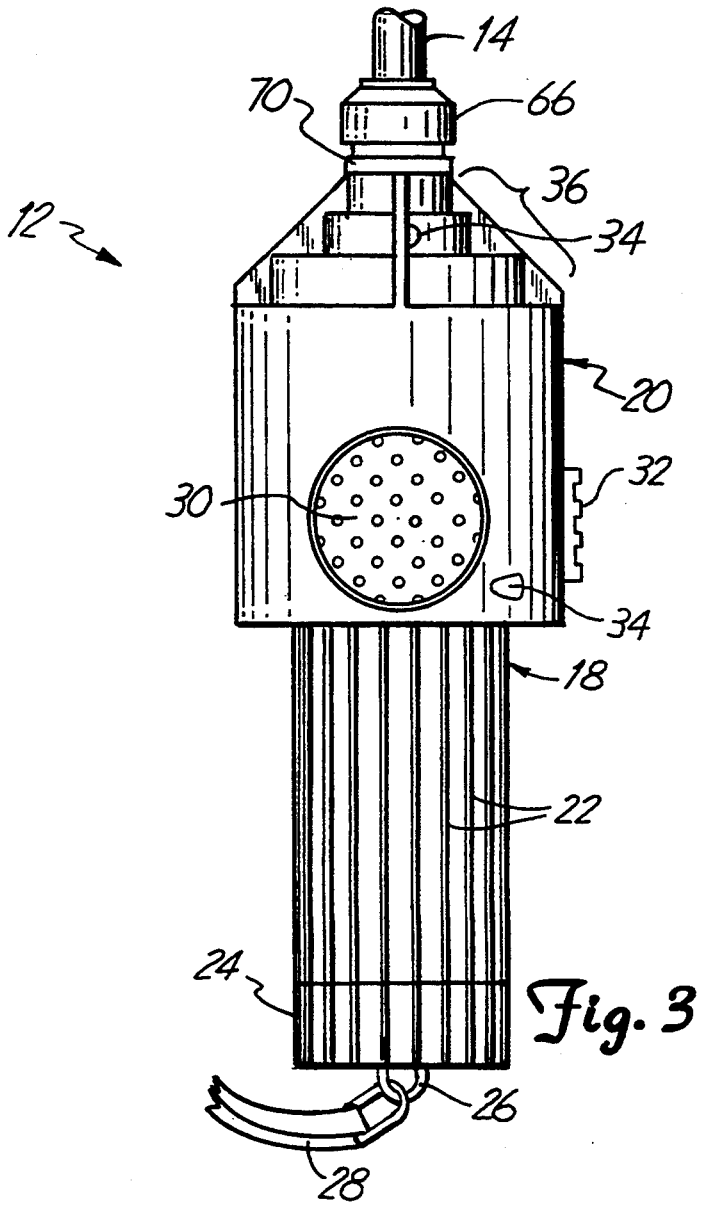
FIG. 3 is a view from the left side elevation of the umbrella handle of the present invention shown in FIG. 2.

As seen in FIG. 2 and FIG. 3, the handle 12 includes a grip 18 adjacent a first end of the handle 12 and a motor casing 20 adjacent a second end of the handle 12. The grip 18 is formed with ribs 22 to improve the user's ability to grasp the handle 12. A removable battery cap 24 is threadably attached at the first end of the handle 12 and is removable to allow the insertion or removal of a battery 38 within the grip 18. Attached to the battery cap 24 is a ring 26 which is used as an attachment point for a wrist strap 28.

Figure 4:
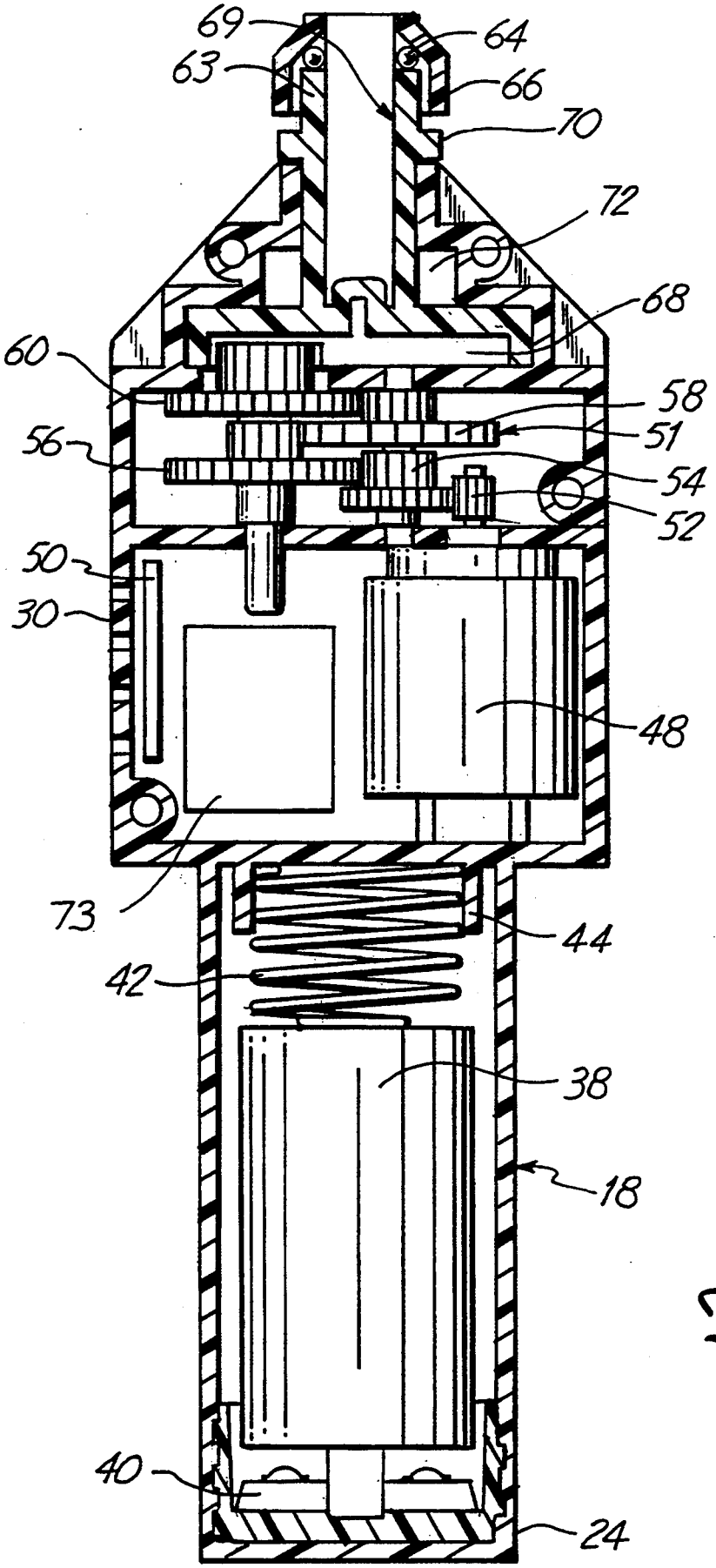
FIG. 4 is a cross sectional view in side elevation of the umbrella handle of the present invention with some parts shown in full.

As seen in FIG. 4, a contact dome 40 is attached to the interior of the battery cap 24. The battery 38 is biased against the contact dome 40 by a spring 42. The spring 42 is held in place by a retaining ridge 44, and is compressed between the battery 38 and a motor casing floor 46.

Figure 3A:
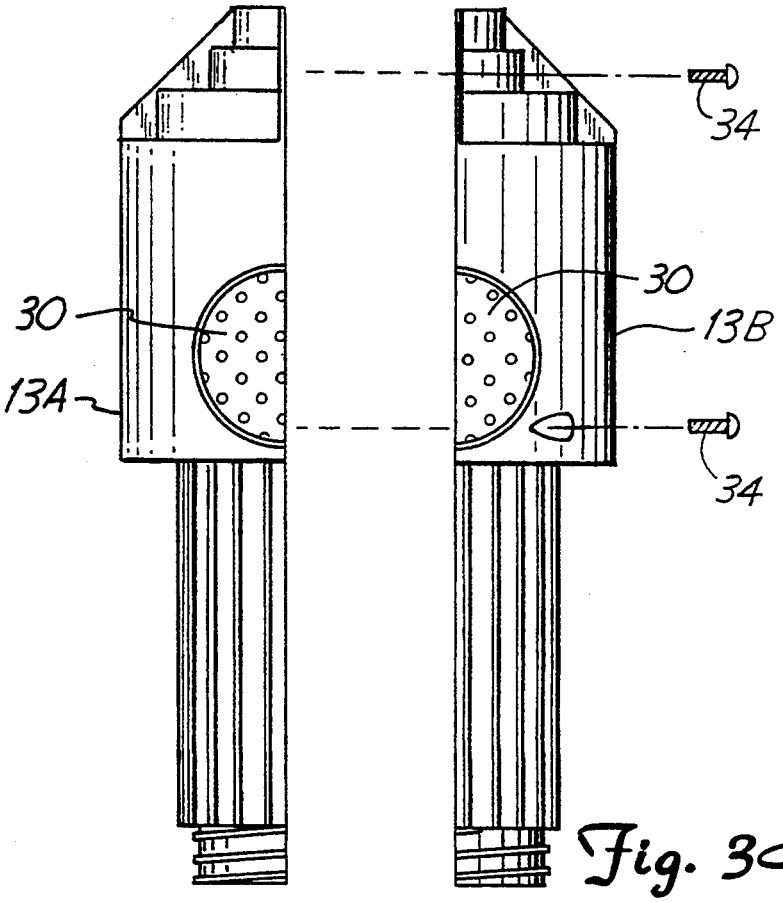
FIG. 3A is an exploded side elevational view showing the two halves of an umbrella handle of the present invention, as taken from the view shown in FIG. 3.

The motor casing 20 includes a speaker grill 30 and a switch 32. The motor casing 20 also includes fasteners 34 which releasably secure together a handle housing portion 13*a* and a handle houseing portion 13*b* as shown in FIG. 3*a*. The motor casing 20 features a stepped portion 36 that provides an increasingly reduced diameter of the motor casing 20 as it approaches the second end of the handle 12.

A motor 48, supplied with power from the battery 38, is contained within the motor casing 20. An example of a suitable motor is Mabuchi motor model RE-260-2670, manufactured by Mabuchi Motor America Corporation of New York, N.Y.

The motor 48 rotates a motor gear 52, and the motor gear 52 in turn drives a gear assembly 51. The gear assembly 51 is also contained within the motor casing 20. The gear assembly 51 includes a spur gear 54, a spur gear 56, a spur gear 58, and a spur gear 60, all of which are interconnected in sequence between the motor gear 52 and an internal spur gear 68. The gear assembly 51 functions to translate torque from the motor 48 to the stem 14, causing rotation of the stem 14 and the dome 16. The effect of the gear assembly 51 is to convert the rotation of the motor 48 at approximately 10,000 r.p.m. to rotation of the stem 14 and the dome 16 at approximately 30 r.p.m. Alternate combinations of gears, including variable gears, may be used for reducing the r.p.m. of the motor 48 to the desired level of rotation of the stem 14 and the dome 16.

A stem receptor 69 is attached to the internal spur gear 68 and extends from the internal spur gear 68 toward the second end of the handle 12. A retaining collar 70 is attached to the exterior of the stem receptor 69 and functions as a load bearing surface for the stem receptor 69. A seal 72 is located between the stem receptor 69 and the stepped portion 36 to prevent contaminants, such as water or dust, from entering the motor casing 20. The end of the stem receptor 69 opposite the internal spur gear 68 includes a threaded portion 63 on the external surface of the stem receptor 69. A nut 66 is threadibly secured to the stem receptor 69. An O-ring 64 is positioned between the nut 66 and the stem receptor 69.

The first end of the stem 14 is inserted into the stem receptor 69 where it is secured by tightening the nut 66 which deforms the O-ring 64 against the stem 14. Alternately, the internal surface of the stem receptor 69 may include a threaded portion to reciprocally engage a threaded portion on the first end of the stem 14, thus allowing the stem 14 and the dome 16 to be threadably secured to the handle 12. The stem 14 and the dome 16 thus may be exchanged for a second stem and dome. The second dome may be imprinted with a design different from the original dome 16, thus providing a new and different visual effect. In a similar manner, the handle 12 may be exchanged for a second handle to provide a different accompanying sound for the first dome.

Figure 5:
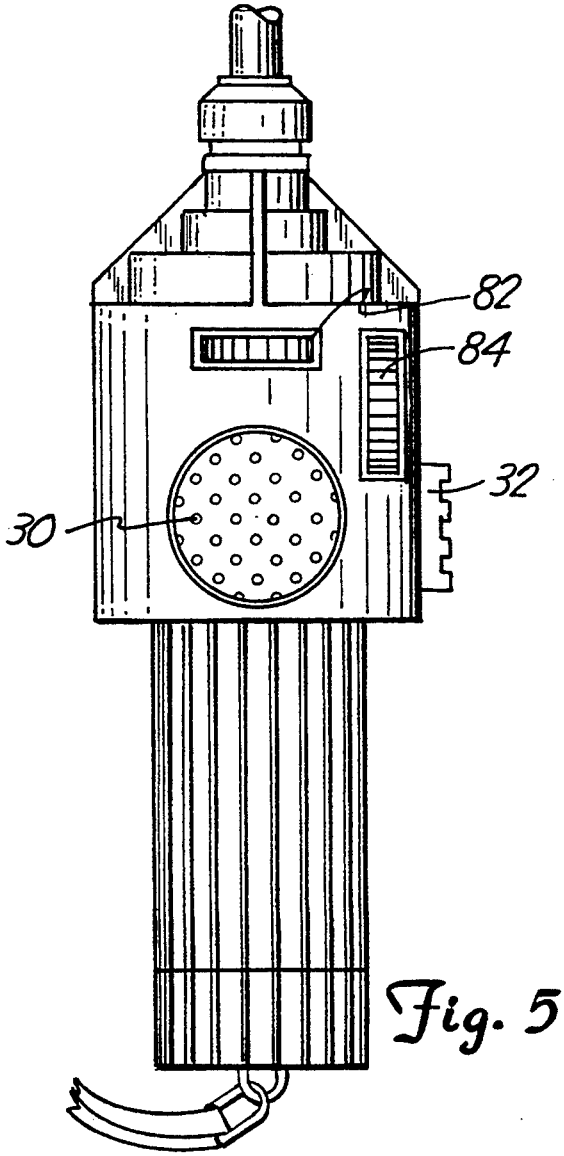
FIG. 5 is a view in side elevation of an alternative embodiment of the present invention showing a radio as a music source.

An audio sound producing means 73 and a speaker 50 are also contained in the motor casing 20. In one preferred embodiment the sound producing means 73 is a sound synthesizer chip. The sound synthesizer chip is a commonly available product, found in such items as audible greeting cards. The sound synthesizer chip is programmed with a predetermined sound which is reproduced when the switch 32 is actuated. The reproduced sound may be chosen so as to appropriately enhance the visual effect created by the design imprinted on the dome 16. The use of a fixable medium, such as a sound synthesizer chip, allows the user to choose music appropriate for the theme or atmosphere created by the umbrella dome 16 or images borne thereon. In alternate embodiments the sound source 73 could comprise any device capable of playing music from a fixable medium such as a compact disc player, a cassette tape player, or a manual input pad, such as an electronic keyboard. The alternate audio source could also, of course, be a radio. FIG. 5 illustrates the handle 12 with an integral radio 80 used as an alternative sound source. The radio 80 includes a tuning thumb wheel 82 and a volume thumb wheel 84.

Figure 6:
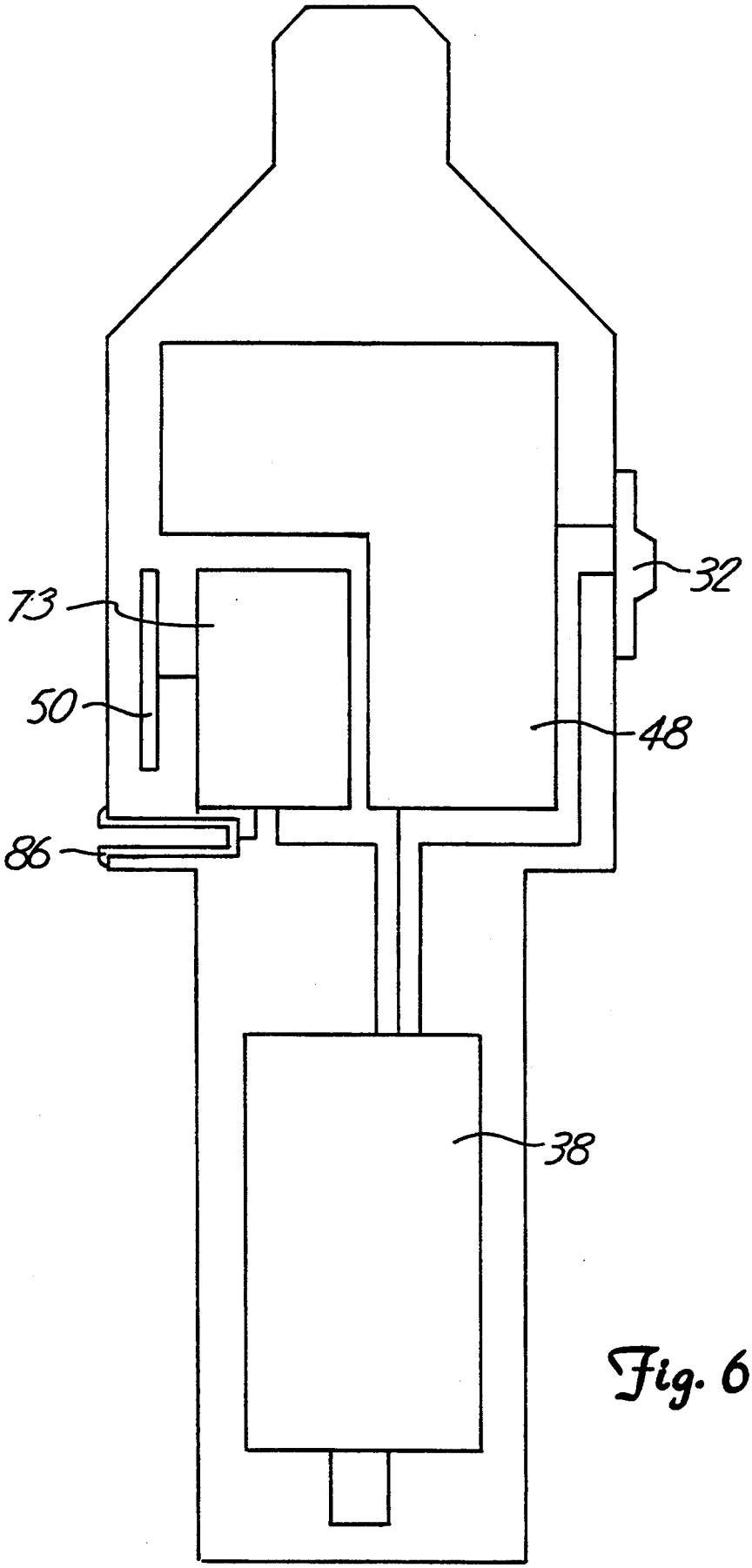
FIG. 6 is a schematic side elevational view of the umbrella handle of the present invention illustrating the electrical connections of the present invention and showing the inclusion of an audio jack for connection of external music sources.

The audio source 73 and the speaker 50, as well as the motor 48, are powered by the battery 38. The switch 32 may be moved to actuate the motor 48 only, or to actuate the motor 48 and the audio source 73 simultaneously. FIG. 6 also shows the inclusion of an audio jack 86 in the motor housing 20. The audio jack 86 may be used to connect an external music source such as a radio, cassette tape player, or compact disc player to the speaker 50 in the handle 12.

The present invention thus provides a hand-held auto-rotating umbrella capable of presenting and creating striking and unusual visual displays through the use of the rotation. The present invention's motorized rotation is more uniform than previous manual techniques, thus enhancing the visual display. The present invention also allows the use of an accompanying sound specifically selected to further enhance the visual display created by the rotating dome 16, rather than relying on a radio.

Although the present invention has been described with reference to preferred embodiments, workers skilled in the art will recognize that changes may be made in form and detail without departing from the spirit and scope of the invention.

What is claimed is:

1. A hand held umbrella comprising:

a dome having an exterior surface with a picture message imprinted thereon, the dome being capable of remaining in a noncollapsed state such that the picture message is observable when the dome is in its noncollapsed state;

a stem for supporting the dome and having a first end and a second end, the dome supported by the stem adjacent the second end of the stem, the first end of the stem having a first threaded portion;

a handle;

means incorporated into the handle for continuously rotating the stem and dome relative to the handle without regular and frequent manual actuation of the handle, the dome capable of remaining in its noncollapsed state during rotation of the stem and dome to allow observation of the picture message such that the rotation of the stem and dome create the visual appearance of animated movement of the picture message on the dome, the rotating means including:

a stem receptor having a first end and a second end, the first end of the stem receptor having a second threaded portion for reciprocally engaging the first threaded portion of the first end of the stem so that the stem is removably attached to the handle, the stem receptor being capable of rotating continuously to rotate the stem and dome;

a gear assembly housed within the handle and having a plurality of gears interconnected in sequence, the gear assembly having a first end and a second end wherein the first end of the gear assembly is permanently engaged to the second end of the stem receptor for causing rotation of the stem receptor; and a battery operated motor housed within the handle and having a motor gear connected to the second end of the gear assembly for causing rotation of the gear assembly;

means for selectively producing audible sounds incorporated into the handle so that the audible sounds are produced during rotation of the stem and dome and the audible sounds being selectable to enhance the aesthetic effect of animated movement of the picture message on the dome as the dome rotates.

2. A hand held umbrella comprising:

a dome having an exterior surface with a picture message imprinted thereon, the dome being capable of remaining in its noncollapsed state such that the picture message is observable when the dome is in a noncollapsed state;

a stem for supporting the dome and having a first end and a second end, the dome supported by the stem adjacent the second end of the stem, the first end of the stem having a first threaded portion;

a handle;

means incorporated into the handle for continuously rotating the stem and dome relative to the handle without regular and frequent manual actuation of the handle, the dome capable of remaining in its noncollapsed state during rotation of the stem and dome to allow observation of the picture message such that the rotation of the stem and dome create the visual appearance of animated movement of the picture message on the dome, the rotating means including:

a stem receptor having a first end and a second end, the first end of the stem receptor having a second threaded portion for reciprocally engaging the first threaded portion of the first end of the stem so that the stem is removably attached to the handle, the stem receptor being capable of rotating continuously to rotate the stem and dome;

a gear assembly housed within the handle and having a plurality of gears interconnected in sequence, the gear assembly having a first end and a second end wherein the first end of the gear assembly is permanently engaged to the second end of the stem receptor for causing rotation of the stem receptor; and a battery operated motor housed within the handle and having a motor gear connected to the second end of the gear assembly for causing rotation of the gear assembly;

means for selectively producing audible sounds incorporated into the handle, the sound producing means comprising a sound synthesizer chip programmed with predetermined audible sounds capable of being reproduced upon actuation of the sound producing means and wherein the predetermined sound is selected to enhance the visual appearance of animated movement of the picture message on the dome as the dome rotates with the picture message in an observable state.

3. The umbrella of claim 2 wherein the handle has a grip portion and a motor casing portion, the motor casing portion enclosing the stem receptor, gear assembly, motor and sound producing means.

4. A hand held umbrella comprising:

a dome having an exterior surface with a picture message imprinted thereon, the dome being capable of remaining in its noncollapsed state such that the picture message is observable when the dome is in a noncollapsed state;

a stem for supporting the dome and having a first end and a second end, the dome supported by the stem adjacent the second end of the stem, the first end of the stem having a first threaded portion;

a handle;

means incorporated into the handle for continuously rotating the stem and dome relative to the handle without regular and frequent manual actuation of the handle, the dome capable of remaining in its noncollapsed state during rotation of the stem and dome to allow observation of the picture message such that the rotation of the stem and dome create the visual appearance of animated movement of the picture message on the dome, the rotating means including:

a stem receptor having a first end and a second end, the first end of the stem receptor having a second threaded portion for reciprocally engaging the first threaded portion of the first end of the stem so that the stem is removably attached to the handle, the stem receptor being capable of rotating continuously to rotate the stem and dome;

a gear assembly housed within the handle and having a plurality of gears interconnected in sequence, the gear assembly having a first end and a second end wherein the first end of the gear assembly is permanently engaged to the second end of the stem receptor for causing rotation of the stem receptor; and a battery operated motor housed within the handle and having a motor gear connected to the second end of the gear assembly for causing rotation of the gear assembly;

means for selectively producing music incorporated into the handle, the sound producing means comprising an audio jack and a speaker, the audio jack being adapted to connected to an external music source, wherein the external music source can be selected to enhance the visual appearance of animated movement of the picture message on the dome as the dome rotates with the picture message in an observable state.

* * * * *

UNITED STATES PATENT AND TRADEMARK OFFICE

CERTIFICATE OF CORRECTION

PATENT NO. : 5,449,012

DATED : SEPTEMBER 12, 1995

INVENTOR(S) : LARRY D. FRIEDMAN

It is certified that error appears in the above-indentified patent and that said Letters Patent is hereby corrected as shown below:

Col. 1, line 54, delete "requiting", insert --requiring--

Col. 3, line 52, delete "houseing", insert --housing--

Col. 8, line 10, delete "connected", insert --connect--

Signed and Sealed this

Ninth Day of January, 1996

*Attest:*

Bruce Lehman

BRUCE LEHMAN

*Attesting Officer*

*Commissioner of Patents and Trademarks*